US009032772B2

(12) United States Patent
Dykstra

(10) Patent No.: US 9,032,772 B2
(45) Date of Patent: May 19, 2015

(54) METHOD AND PROCESS FOR FORMING A PRODUCT

(71) Applicant: Temper IP, LLC, Rockford, MI (US)

(72) Inventor: William C. Dykstra, Rockford, MI (US)

(73) Assignee: Temper IP, LLC, Rockford, MI (US)

( * ) Notice: Subject to any disclaimer, the term of this patent is extended or adjusted under 35 U.S.C. 154(b) by 0 days.

(21) Appl. No.: 13/936,712

(22) Filed: Jul. 8, 2013

(65) Prior Publication Data

US 2013/0298629 A1 Nov. 14, 2013

Related U.S. Application Data

(63) Continuation of application No. 12/124,347, filed on May 21, 2008, now Pat. No. 8,479,552.

(60) Provisional application No. 60/939,463, filed on May 22, 2007.

(51) Int. Cl.

| | |
|---|---|
| ***B21D 26/033*** | (2011.01) |
| ***B21D 37/16*** | (2006.01) |
| ***B21D 22/02*** | (2006.01) |

(52) U.S. Cl.

CPC ..... *B21D 26/033* (2013.01); *B21D 37/16* (2013.01); *B21D 22/022* (2013.01); *B21D 22/025* (2013.01)

(58) Field of Classification Search

CPC .. B21D 22/025; B21D 26/033; B21D 26/041; B21D 26/047; B21D 37/16

USPC ..... 72/54, 56, 60, 61, 62, 342.1, 342.3, 72/342.4, 342.5, 342.7, 342.8; 219/635, 219/643, 645, 676, 677; 148/567, 570, 574

See application file for complete search history.

(56) References Cited

U.S. PATENT DOCUMENTS

| | | | |
|---|---|---|---|
| 2,317,597 | A | 4/1943 | Ford et al. |
| 2,461,323 | A | 2/1949 | Hille |
| 2,755,689 | A | 7/1956 | Sundback |
| 2,852,649 | A | 9/1958 | Limpel |
| 3,126,937 | A | 3/1964 | Brower et al. |

(Continued)

FOREIGN PATENT DOCUMENTS

| | | | | |
|---|---|---|---|---|
| EP | 0246838 | A2 * | 11/1987 | ..... B21D 37/16 |
| JP | 64-45735 | A * | 2/1989 | ..... C03B 11/00 |

(Continued)

*Primary Examiner* — Edward Tolan

(74) *Attorney, Agent, or Firm* — Gardner, Linn, Burkhart & Flory, LLP

(57) ABSTRACT

A method of forming a product via induction heating and forming of the product includes providing an induction heating coil for induction heating of a component and providing a die forming shell for supporting the component and for defining the final shape of a formed product formed from the component. The die forming shell includes a metallic material. A support structure is provided for supporting the die forming shell during the induction heating of the component. The support structure includes a metallic material. The support structure includes insulating portions to limit or substantially preclude inducement of electrical current through the support structure during the induction heating process. The component is inductively heated along its length while the component is in the die forming shell. The component is at least one of (a) heated before the formed product is formed and (b) heated while the formed product is formed.

14 Claims, 17 Drawing Sheets

(56) References Cited

U.S. PATENT DOCUMENTS

| | | | | | |
|---|---|---|---|---|---|
| 3,250,104 | A | | 5/1966 | Fischer | |
| 3,560,692 | A | * | 2/1971 | Briles | 219/602 |
| 3,605,477 | A | | 9/1971 | Carlson | |
| 3,679,807 | A | | 7/1972 | Carcey | |
| 3,972,744 | A | | 8/1976 | Cantrell | |
| 3,981,653 | A | * | 9/1976 | Greenhalgh et al. | 425/113 |
| 4,437,326 | A | | 3/1984 | Carlson | |
| 4,496,131 | A | | 1/1985 | Yang | |
| 4,569,218 | A | | 2/1986 | Baker et al. | |
| 4,659,056 | A | | 4/1987 | Michaud-Soret | |
| 4,867,810 | A | * | 9/1989 | Novorsky | 148/572 |
| 5,040,399 | A | | 8/1991 | Knapper et al. | |
| 5,410,132 | A | | 4/1995 | Gregg et al. | |
| 5,530,227 | A | | 6/1996 | Matsen et al. | |
| 5,645,744 | A | | 7/1997 | Matsen et al. | |
| 5,682,783 | A | | 11/1997 | Creamer et al. | |
| 5,683,608 | A | | 11/1997 | Matsen et al. | |
| 5,699,693 | A | | 12/1997 | Nogami et al. | |
| 6,083,329 | A | * | 7/2000 | Tsuchiya et al. | 148/526 |
| 6,322,645 | B1 | | 11/2001 | Dykstra et al. | |
| 6,613,164 | B2 | | 9/2003 | Dykstra et al. | |
| 6,810,709 | B2 | | 11/2004 | Hammar et al. | |
| 6,884,975 | B2 | * | 4/2005 | Matsen et al. | 219/615 |
| 7,003,996 | B2 | | 2/2006 | Dykstra et al. | |
| 7,024,897 | B2 | | 4/2006 | Pfaffmann et al. | |
| 7,159,437 | B2 | | 1/2007 | Schroth et al. | |
| 7,269,986 | B2 | | 9/2007 | Pfaffmann et al. | |
| 7,305,860 | B2 | | 12/2007 | Yang et al. | |
| 7,360,387 | B2 | | 4/2008 | Otaki | |
| 7,388,178 | B2 | * | 6/2008 | Hennessey | 219/635 |
| 7,406,852 | B2 | | 8/2008 | Otaki | |
| 7,654,125 | B2 | | 2/2010 | Hammar et al. | |
| 7,891,075 | B2 | | 2/2011 | Mankame et al. | |
| 8,381,562 | B2 | * | 2/2013 | Schroth et al. | 72/342.1 |
| 2005/0074609 | A1 | * | 4/2005 | Veariel et al. | 428/402 |

FOREIGN PATENT DOCUMENTS

| | | | | | |
|---|---|---|---|---|---|
| JP | 3295188 | | | 12/1991 | |
| JP | 6297049 | | | 10/1994 | |
| WO | 2007/112711 | A1 | * | 11/2007 | B21D 37/16 |

* cited by examiner

METHOD AND PROCESS FOR FORMING A PRODUCT

CROSS REFERENCE TO RELATED APPLICATIONS

The present application is a continuation of U.S. patent application Ser. No. 12/124,347, filed May 21, 2008, now U.S. Pat. No. 8,479,552, which claims the benefit of U.S. provisional application No. 60/939,463, filed May 22, 2007, which are hereby incorporated herein by reference in their entireties.

BACKGROUND OF THE INVENTION

The present invention is directed to a method and die for forming a tubular blank into a structural component.

It is known to take tubular structures and mold them into structural components having different diameters and shapes. It has been proposed to accomplish such forming via induction heating of the tubular form and inflating the form with a gas to form the structural component. The induction heating process generates heat within a material by inducing a current in the material, whereby the material's resistance to the electrical current generates heat as the current is passed therethrough. Examples of such induction heating processes are described in U.S. Pat. Nos. 7,269,986; 7,024,897; 7,003,996; 6,613,164; and 6,322,645, which are hereby incorporated herein by reference in their entireties. Other methods or systems for super plastic forming of a metal plate via induction heating coils are described in U.S. Pat. Nos. 5,410,132; 5,530,227; 5,645,744; and 5,683,608, which are hereby incorporated herein by reference in their entireties. Although the induction heating and gas forming processes and systems described in these patents and otherwise known in the art may function for their intended purposes, such systems are not suitable to be made from a metallic structure.

SUMMARY OF THE INVENTION

The present invention provides a support structure for supporting a die forming mold or shell during an induction heating process for heating a flat blank and/or a tubular structure disposed within the die forming shell and for forming the flat blank and/or inflating the tubular structure with a gas to form the tubular structure into the shape defined by the internal surfaces of the die forming shell. The die forming shell may comprise a metallic material, such as inconel or stainless steel or cobalt or the like, and the support structures or ribs may also comprise a metallic material, such as inconel or stainless steel or cobalt or the like and/or other materials of low permeability, such as ceramic materials. Although the die forming shell and support ribs may comprise a metallic material, the induction heating of the tubular structure contained within the die forming shell is accomplished without excessive heating to the die forming shell itself or to the structural support ribs, as discussed in detail below. The selected materials for the die forming shell and the support ribs may comprise a suitable material, such as a metallic material, such as a metallic material comprising a low magnetic material with a high inductive heating reference depth. Such material properties reduce or limit the heating of the die forming shell and support ribs during the induction heating process. The die forming shell and support ribs are formed such that the shell and/or support ribs include gaps or isolated regions or insulated regions to open an otherwise closed electrical circuit to limit or substantially preclude current flow along and around the shell and/or ribs, thereby limiting or substantially precluding induction heating of the shell and/or ribs during the induction heating process that heats the tubular member disposed in the die forming shell supported by the ribs.

In one form, the support ribs have generally triangular-shaped rib portions or support portions disposed at either side of the lower portion and upper portion of the die forming shell and spaced along the length of the die forming shell. The ribs include gaps between portions thereof, with an insulating material or ceramic coating or the like disposed at the gaps so as to electrically insulate the opposed portions of the ribs at the gaps. The strategically located gaps limit or substantially preclude the induced current from completing a current path around the ribs or support structure.

Optionally, the die forming shell may include a plurality of tabs extending therefrom for attaching the shell to the ribs. In such an application, the ribs receive the tabs within a slotted portion or mounting portion of the ribs, with the surfaces of the slotted portion of the ribs being ceramic coated and/or the surface of the tab being ceramic coated (or otherwise electrically insulated or isolated), so as to electrically insulate the tabs of the die forming shell from the support ribs. Preferably, the die forming shell is retained at the ribs and at the slotted region of the ribs via a retaining element or pin, such as a ceramic pin or carbide pin or the like, which is received through apertures or slots in the support ribs and an aperture or slot in the tabs of the die forming shell. The tabs and the support ribs may include open slots instead of apertures to further reduce or limit or substantially preclude electrical current from flowing around a closed circuit formed by the apertures and thereby limit the heating of the shell and/or support ribs during the heating induction process.

Therefore, the present invention provides a metallic support structure and die forming shell for heating and forming a structural tubular member via induction heating of the tubular member. The metallic support structure and die forming shell of the present invention provide the support of the tubular member during the induction heating process, and are configured so as to limit heating of the support structure and die forming shell during the induction heating process.

These and other objects, advantages, purposes and features of the present invention will become apparent upon review of the following specification in conjunction with the drawings.

DESCRIPTION OF THE PREFERRED EMBODIMENTS

Figure 1:
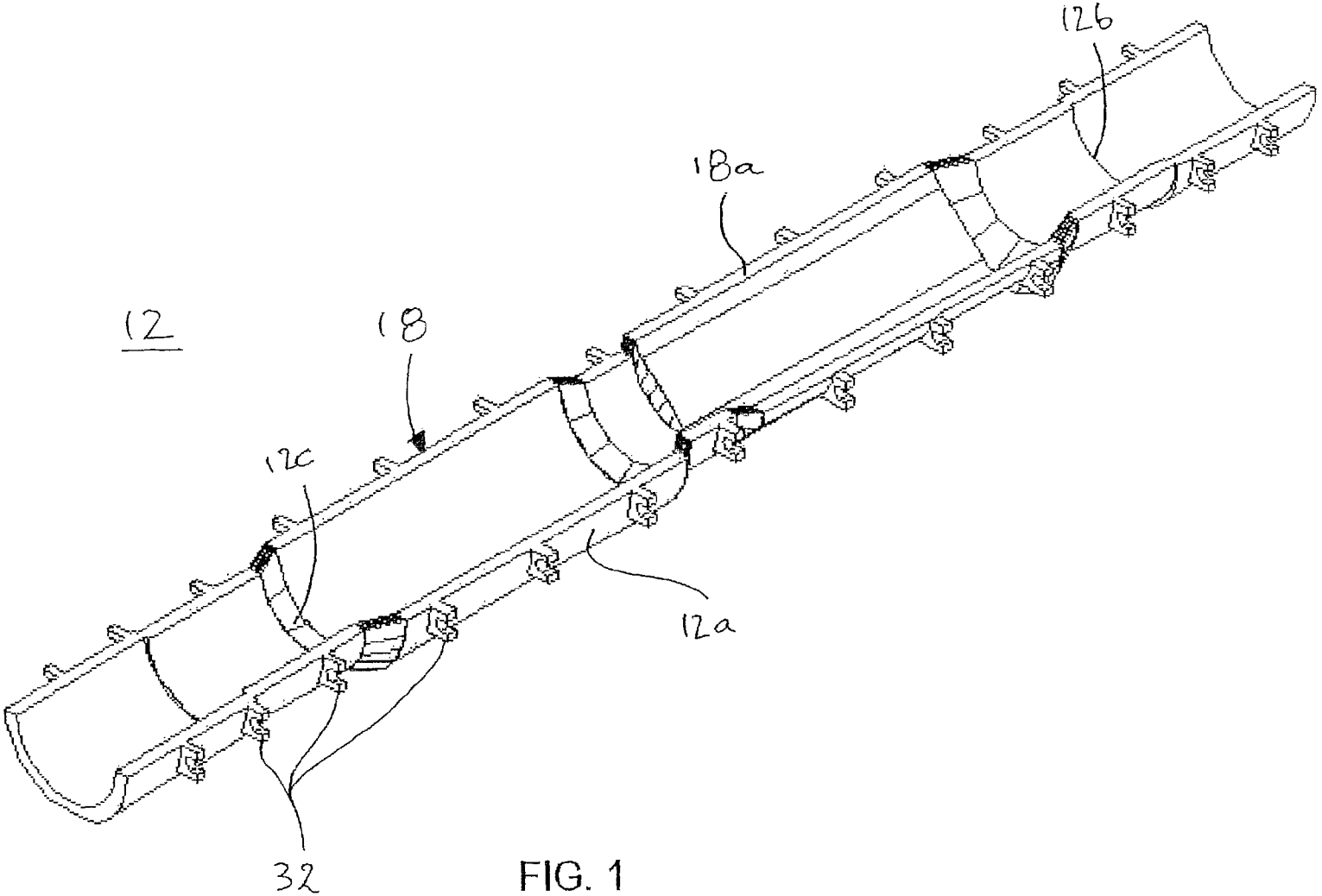
FIG. 1 is a perspective view of a half of a die forming shell for forming a three-dimensional tubular structure in accordance with the present invention.

Referring now to the drawings and the illustrative embodiments depicted therein, a hot metal gas forming system or component forming system or assembly 10 includes a die forming or shape imparting shell 12 that is attached to and supported on or at a plurality of support ribs 14, which are spaced apart so that a plurality of inductive heating coils 16 may be disposed between the support ribs 14 and around the die forming shell 12 for heating a tubular member or component disposed within the die forming shell 12. In the illustrated embodiment of FIGS. 1-6, only a first or lower half or portion 18 of the die forming shell 12 and support ribs 14 and inductive heating coil 16 is shown. However, die forming shell 12 comprises two opposed halves or portions, such as a lower portion 18 and an upper or second half or portion 20 (FIG. 5) that are mated together to form the generally tubular die forming shell 12. Thus, the tubular member or component may be placed in one of the shell portions, such as lower portion 18, whereby the other shell portion, such as upper portion 20, may be mated to lower portion 18 to substantially encase and enclose the component within the die forming shell. Likewise, inductive heating coils 16 are shown as a plurality of coils that each extend at least partially around die forming shell 12. However, and as can be seen with reference to FIG. 11, inductive heating coils 16 are arranged and configured so as to extend substantially or entirely around die forming shell 12, such that when a current is generated along the induction heating coil, the current induces an electrical current in the component within die forming shell 12 to heat the component via the induction heating process.

Figure 10:
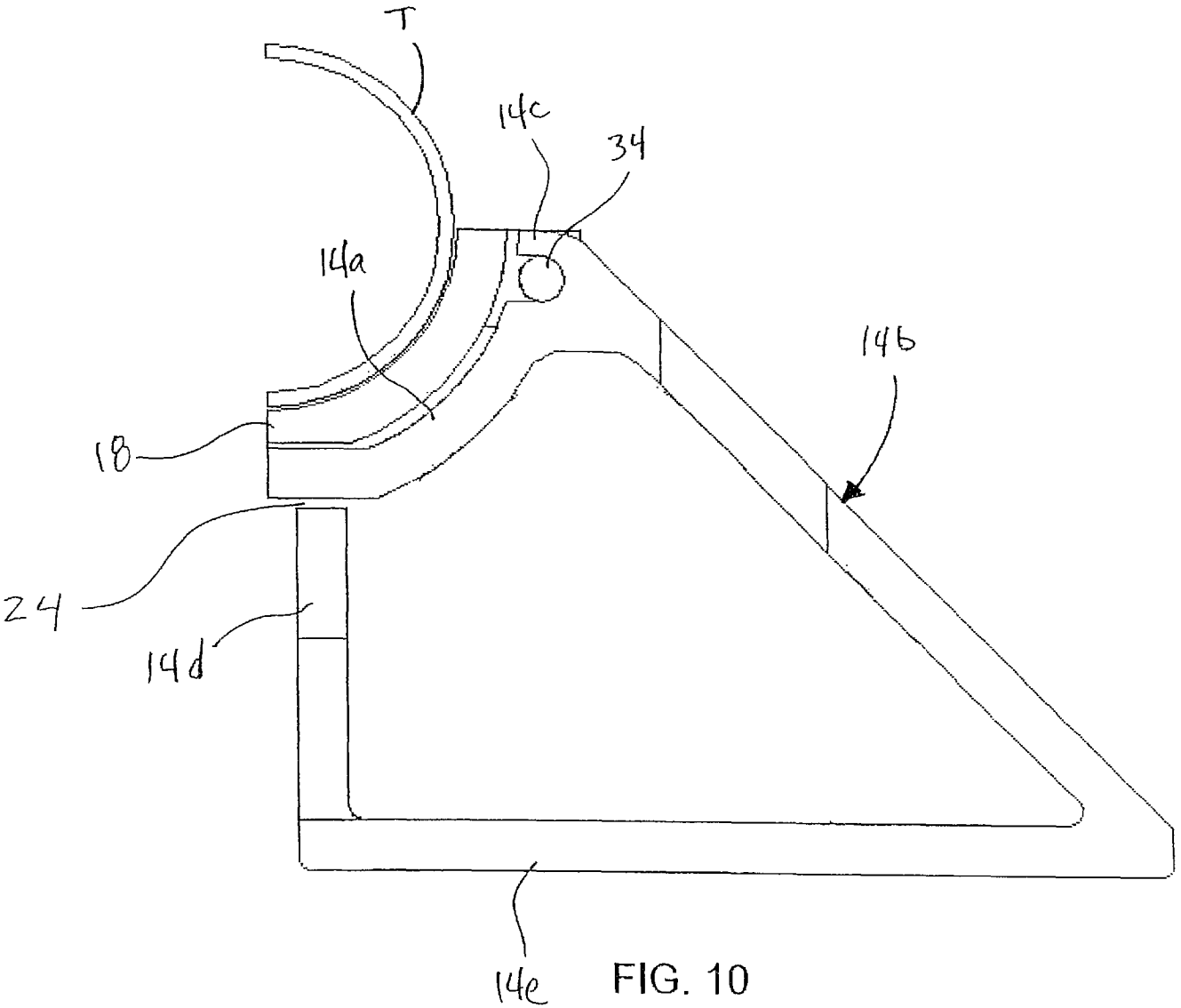
FIG. 10 is an end view of one side of the lower portion of the die forming shell and support ribs of the present invention.
Figure 11:
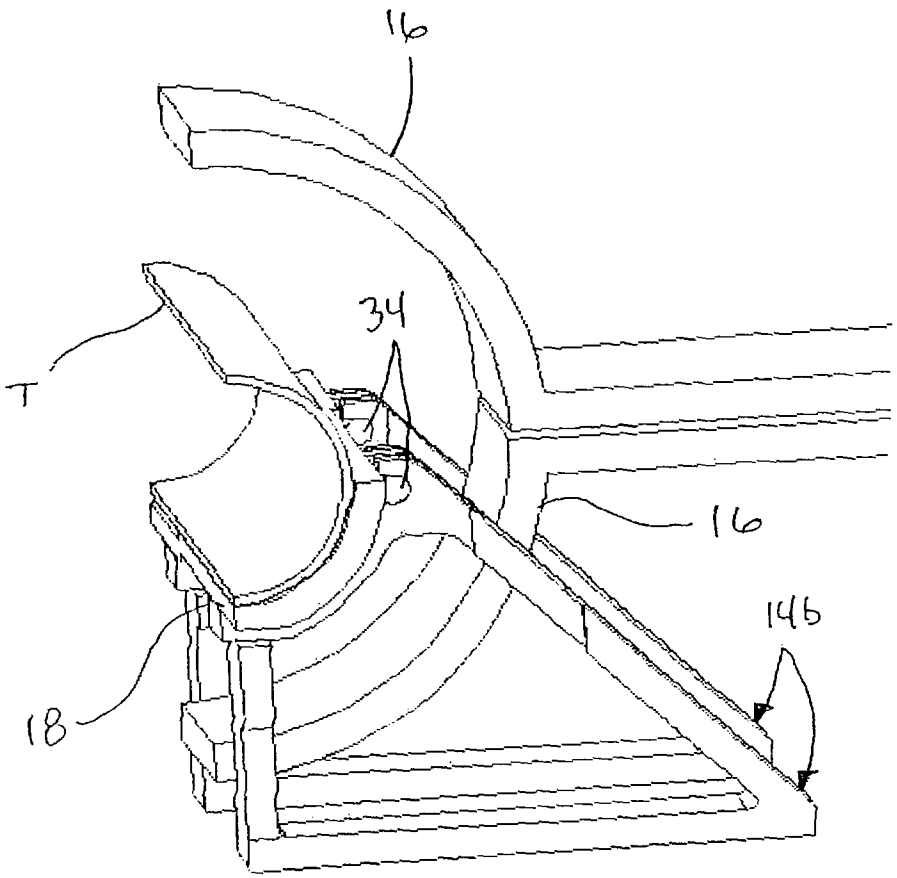
FIG. 11 is a perspective view of a portion of the die forming shell and support ribs and inductive coil of the present invention.
Figure 13:
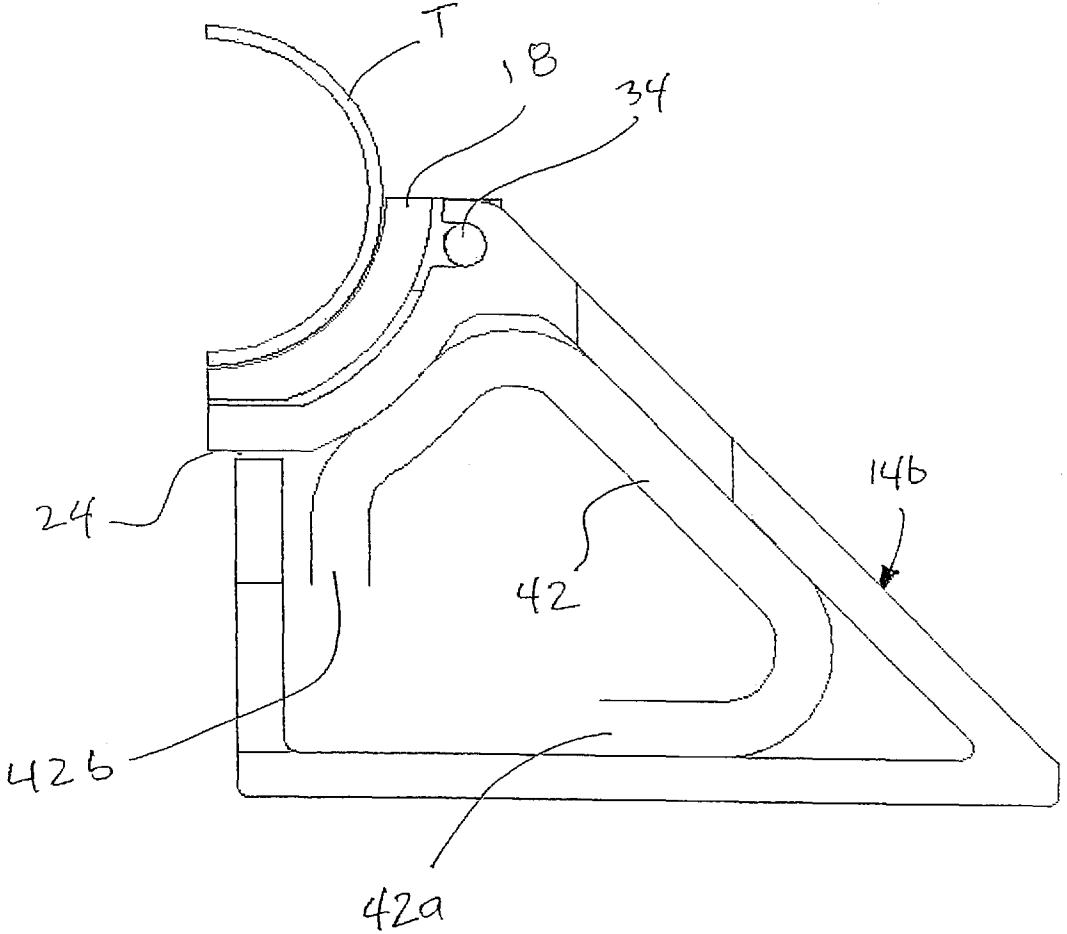
FIG. 13 is an end elevation of a portion of the die forming shell and support ribs of the present invention, shown with a fluid cooling coil established thereat.

In the illustrated embodiment, the component formed within the die forming shell comprises a tubular member T (a portion of which is shown in FIGS. 10, 11, and 13). Tubular member T may be a tubular metal blank and may comprise any electrically conductive material, preferably a metallic material, such as steel, aluminum, magnesium, titanium or the like. Optionally, tubular member T may comprise a plastic or polymeric or engineered plastic material or the like, such as, for example, a composite plastic material or other suitable material. Tubular member T may comprise a unitary tubular blank or may comprise a welded or fused assembly of more than one tubular blank. Such blanks could be welded end-to-end and/or welded end-to-end and joined in a T-shaped configuration, and/or a multiple "T" configuration. Such individual blanks could be made from two or more different material types and/or thicknesses, depending on the particular application and desired end product. Optionally, tubular member T may comprise a uniform thickness or a non-uniform thickness, and/or may comprise a uniform or non-uniform composition. Optionally, the tubular metal blank may have one or more stiffening members or elements disposed therein or therealong. Such stiffening elements may serve to enhance the rigidity or strength or the like of tubular member T. Optionally, the component may be a two sided component, such as a plate or a flat or substantially planar member or blank, which may be formed by a die forming shell wherein one half is a punch and the other half is a die.

Figure 4:
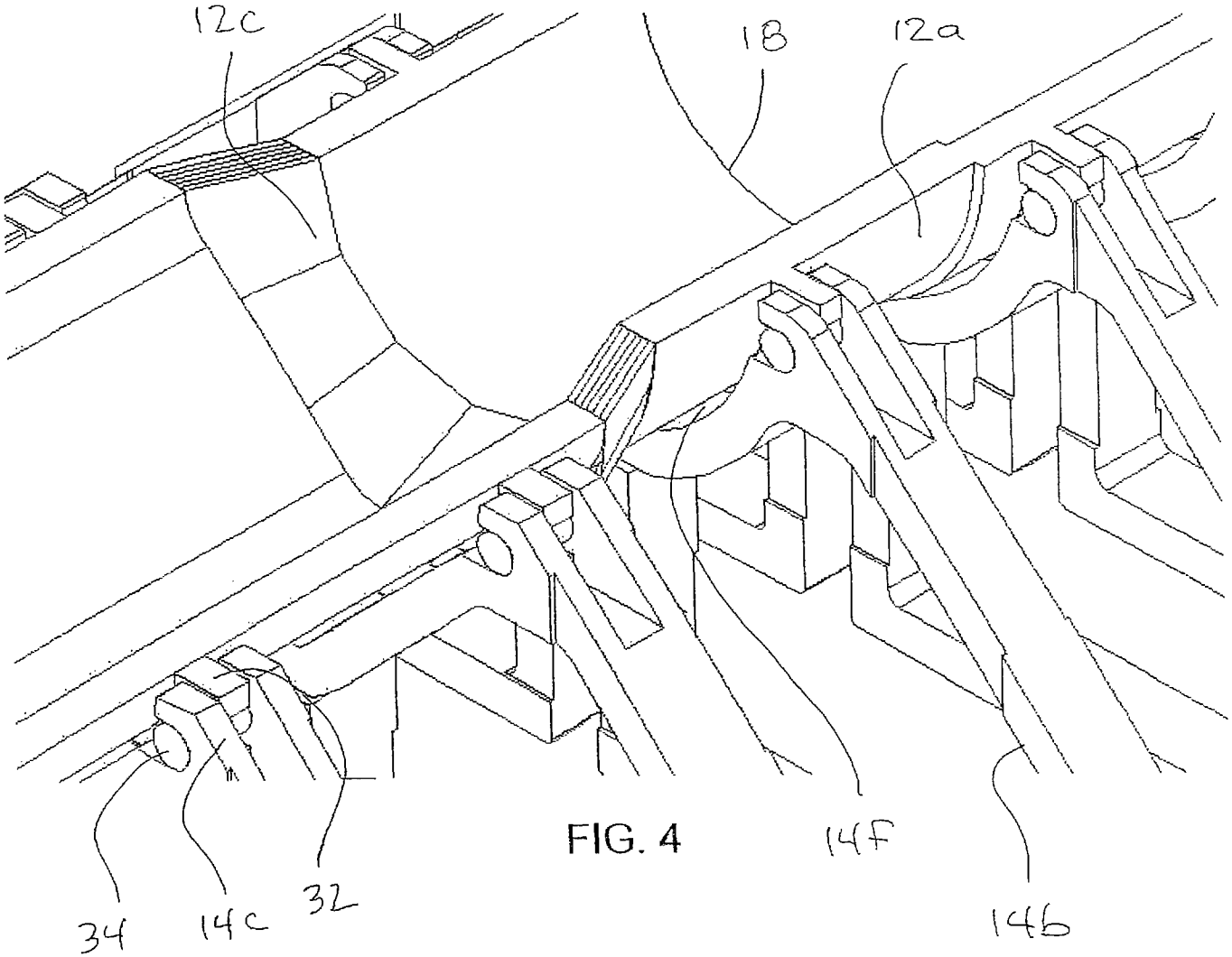
FIG. 4 is an enlarged perspective view of a portion of the half of a die forming shell and support ribs of the present invention.
Figure 5:
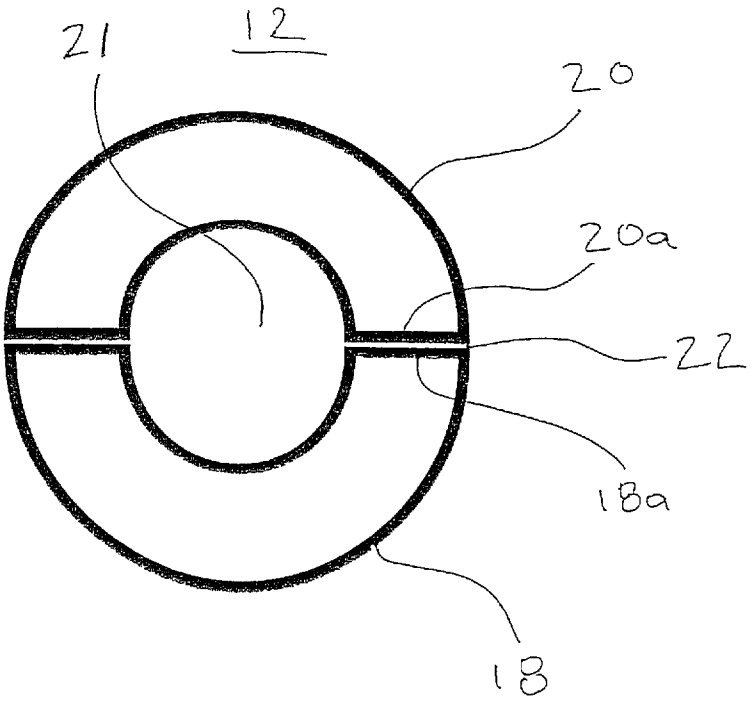
FIG. 5 is a sectional view of the die forming shell when the upper and lower halves of the shell are assembled together.
Figure 6:
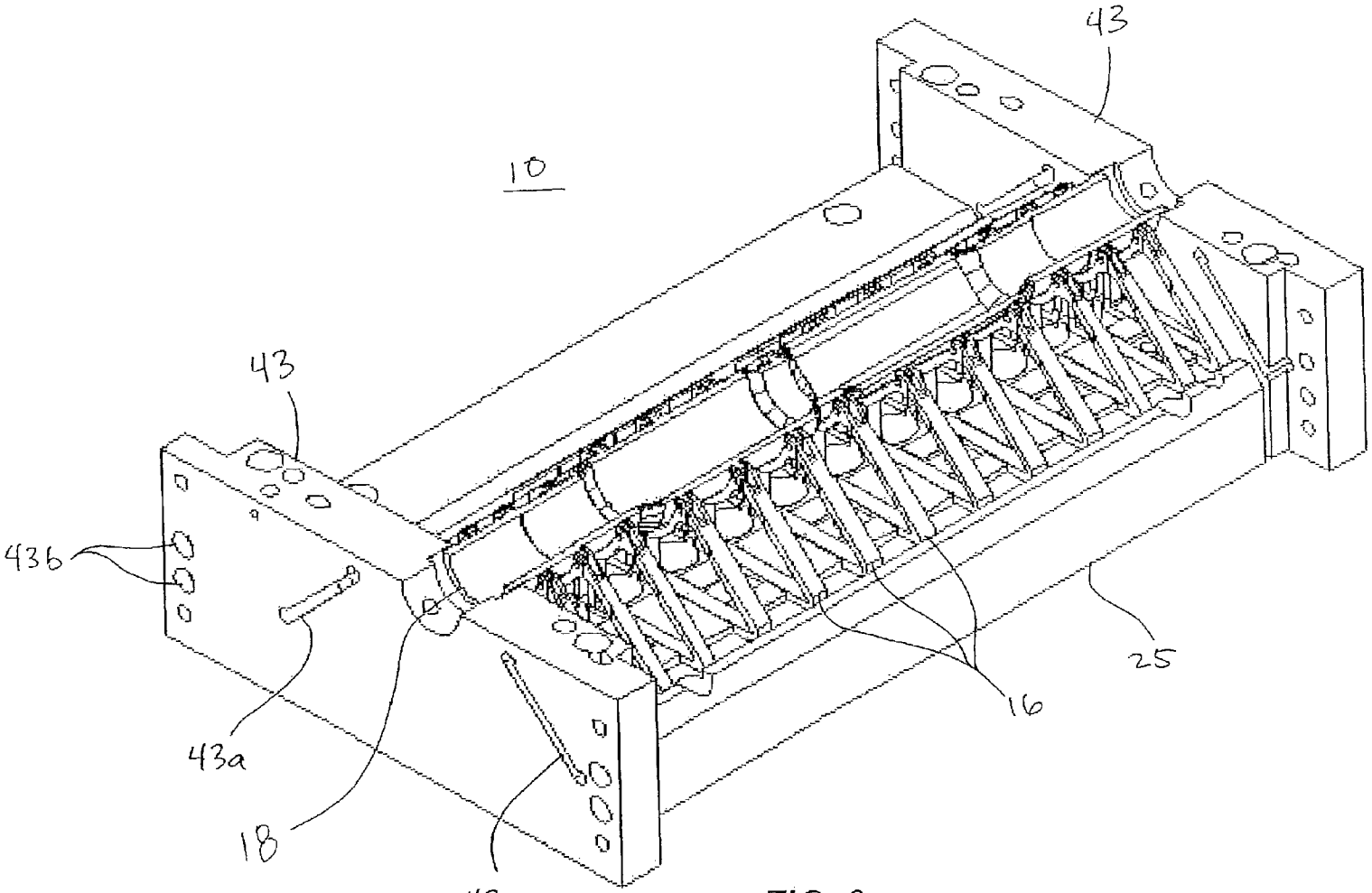
FIG. 6 is a perspective view of the die forming shell and support ribs, with the end plates shown attached at the ends of the die forming shell in accordance with the present invention.

In the illustrated embodiment, and as best seen in FIGS. 1 and 4-5, die forming shell 12 (when the portions are mated or substantially mated together) may comprise an elongated substantially cylindrical member with an inner surface that has a profile that includes one or more chamfers 12*c* and/or steps 12*b* for imparting varying diameters and/or shapes to tubular member T during the forming process described in detail below. For example, two portions (such as a lower portion and an upper portion or the like) of the die forming shell are substantially mated together so that the inner surfaces of the two portions cooperate to form a cavity 21 that defines or forms the shape of the formed product that is heated and expanded therein. Alternatively, the cavity may be defined by a die forming shell comprising more than two portions. Also, the cavity may take a variety of shapes and/or configurations (such as including chamfers and/or steps as discussed above), depending on the particular application and desired formed end component. As will be apparent to one of ordinary skill in the art, the die forming shell may include other features and may take other forms without departing from the spirit and scope of the present invention. Die forming shell 12 may comprise any suitable material, such as a metallic material, such as a metallic material having a low magnetic characteristic and a high inductive heating reference depth (described below). For example, the die forming shell may comprise inconel, stainless steel or cobalt or other suitable metallic material. In order to limit or reduce any current flow around and/or through die forming shell 12 that may be induced by the inductive heating coils, the opposed or mating surfaces or portions 18*a*, 20*a* of the upper and lower portions 18, 20 (FIG. 5) of the shell may optionally be coated with a non-conductive material, such as a non-conductive ceramic material or the like. Alternatively or in addition to such coating, an insulating element or coating may be disposed in a gap or void 22 (described in detail below) between the shell portions 18, 20 to limit or substantially preclude passage of electrical current therethrough.

Figure 2:
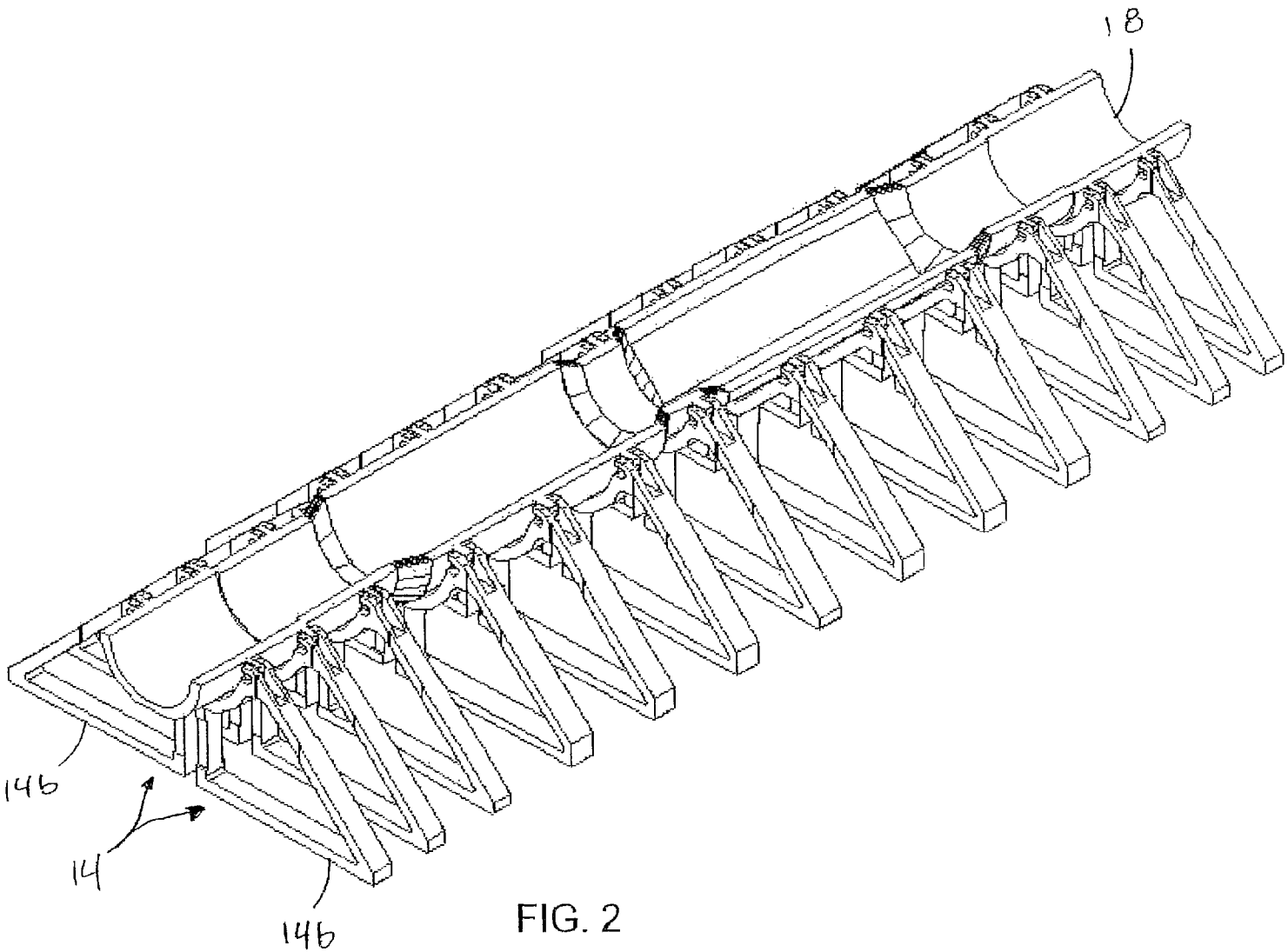
FIG. 2 is a perspective view of the half of a die forming shell as supported by a plurality of support ribs in accordance with the present invention.
Figure 3:
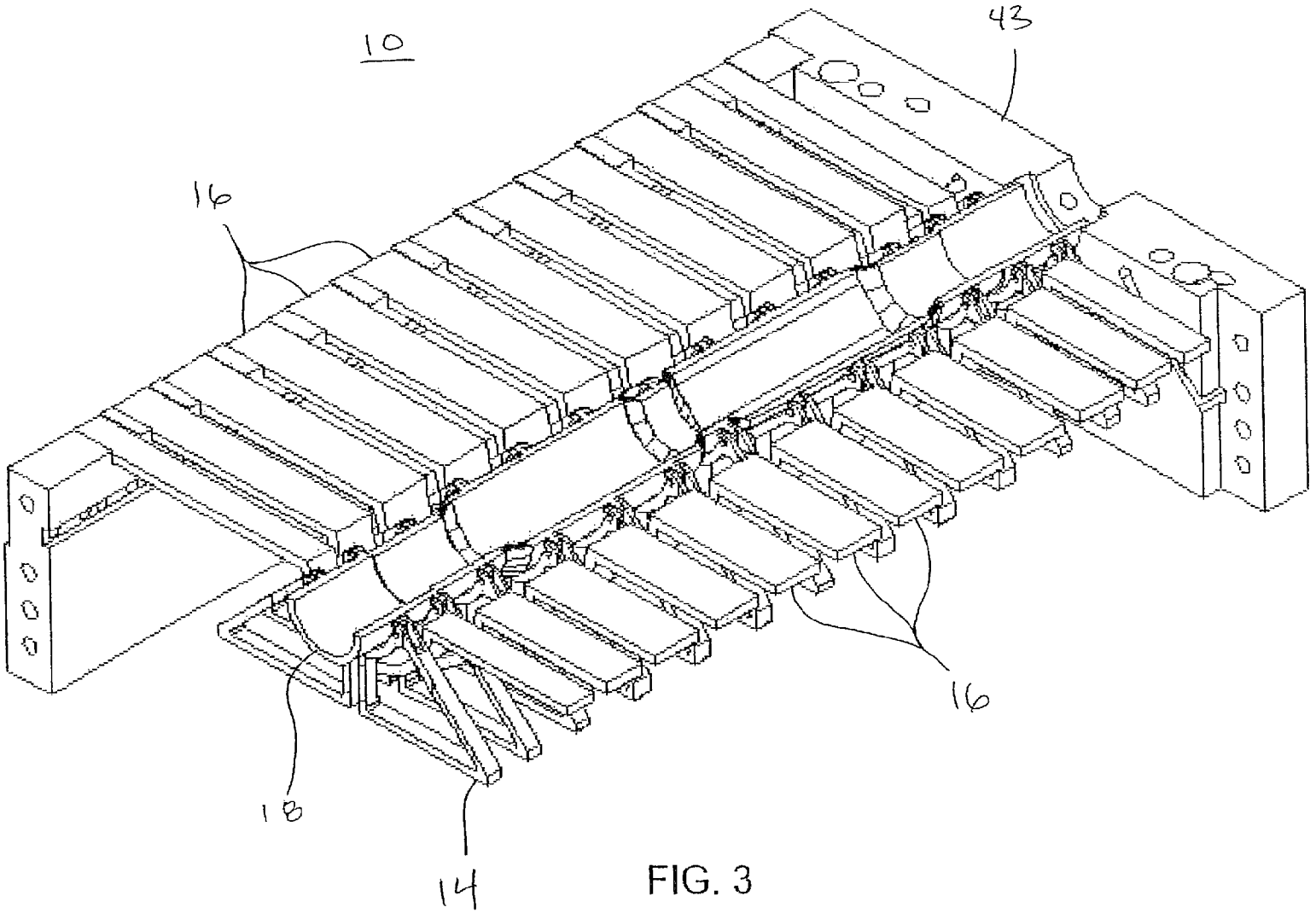
FIG. 3 is a perspective view of the half of a die forming shell and support ribs of FIG. 2, showing the inductive heating coils disposed around the shown half of the die forming shell.
Figures 7A, 7B:
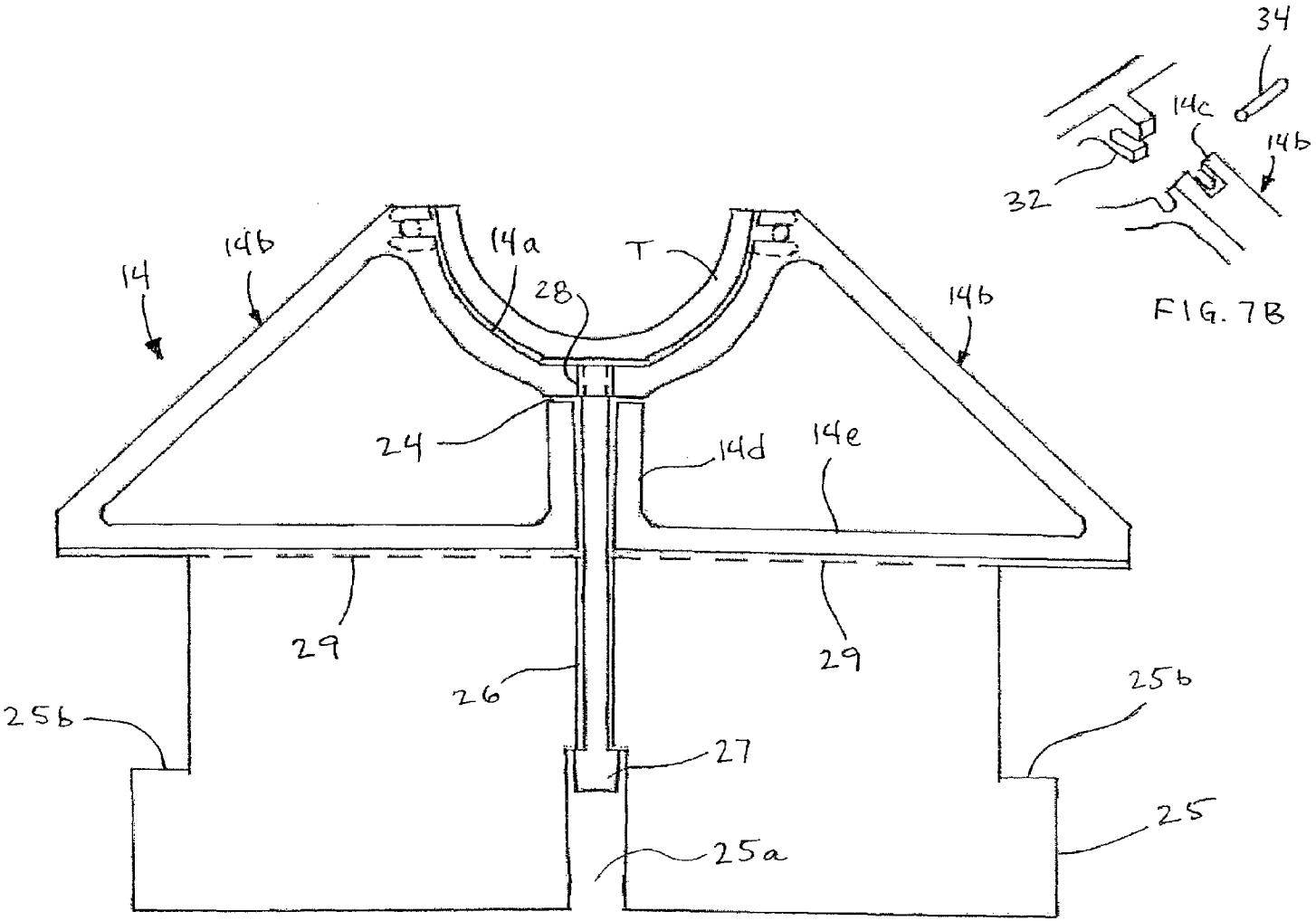
FIG. 7A is an end elevation of a lower portion of the die forming shell and the support ribs of the present invention.
FIG. 7B is an enlarged view of a portion of the die forming shell and the support ribs of FIG. 7A, illustrating components thereof.

In the illustrated embodiment, support ribs 14 comprise generally triangular-shaped rib portions or support portions 14*b* (FIGS. 7A and 10) that each support a quarter portion (or other portion depending on the support configuration of the particular application) of an elongated die forming shell 12. As can be seen in FIGS. 2, 3 and 7A, a plurality of pairs of support ribs 14 are spaced along die forming shell 12 and attached thereto for supporting lower portion 18 of die forming shell 12 at the die or tool. Support ribs 14 may comprise a metallic material, and preferably a low magnetic material with a high inductive heating reference depth, such as inconel, stainless steel or cobalt or other suitable metallic material or the like. The support ribs are configured with a plurality of gaps or insulating portions therealong to limit or substantially preclude the flow of electrical current around the support ribs, in order to reduce or limit inductive heating of the support ribs during the inductive heating process, as discussed below. Both the die forming shell and the support ribs thus may comprise metallic components, yet are configured and formed so as to be substantially non-electrically magnetic and thus substantially resistant to electrical current flowing therethrough. Thus, the shell and the support ribs do not provide a circuit for flow of electrical current therethrough and therearound, which limits the heating of the components of the die during the induction heating process that heats the tubular member within the die forming shell, as also discussed below.

Selection of a suitable material for die forming shell 12 and/or support ribs 14 depends in part on its inductive heating reference depth. Different materials have different inductive heating reference depths. The reference depth is the depth of penetration that an inductive heating field of a given frequency may penetrate into the material when the induced current flows. For steel or aluminum, the heating reference depth is relatively shallow, such as about 0.030 inches to about 0.120 inches in depth at about a 10 KHz frequency. For inconel or stainless steel, however, the reference depth is much greater, such as around 0.20 inches at about a 10 KHz frequency. Thus, because it is desirable to heat the component or workpiece and not the die (comprising die forming shell 12 and support ribs 14) that is within or that could be affected by the inductive heating fields, it is desirable that the die be substantially "invisible" or transparent to the heating field. Thus, the selected material for the die components is preferably a low magnetic material with a high inductive heating reference depth, such as inconel or stainless steel or cobalt material or the like. However, it will be apparent to one of skill in the art that other suitable materials may be used while remaining within the spirit and scope of the present invention. Further, as will be described in more detail below, the present invention provides other methods for promoting such transparency of die components to current flow.

As best shown in FIGS. 7A and 10, the die includes spaced apart support ribs 14, with each support rib comprising a pair of lower generally triangular-shaped side regions or portions 14*b* (with the upper support portions (not shown) being inverted but otherwise substantially similar to the lower portions) that may be joined together or integrally formed together such that there is a generally U-shaped upper region 14*a* adapted or configured to receive a portion of the die forming shell. Optionally, the support rib may comprise a separate U-shaped portion or component adapted to abut or join the side portions. In the illustrated embodiment, a plurality of support ribs are spaced apart along and attached to a base 25 (FIG. 6) and secured thereto by a bolt or fastener 27 (such as a non-magnetic stainless steel bolt or the like). As best seen in FIG. 7, the bolt may pass through a bore or passageway 26 through base portion 25, between a generally central region extending between vertical legs 14*d* of the support ribs, and into a threaded opening 28 of the lower and central region of the generally U-shaped upper portion of the support rib. Optionally, and desirably, a plurality of support ribs are spaced at regular or generally regular intervals along the length of die forming shell 12 to support the shell.

For example, and as can be seen in FIG. 10, support rib 14 comprises generally U-shaped region 14*a* and opposite, hollow or generally triangular-shaped rings or support portions 14*b* for vertically and laterally supporting die forming shell 12 in die 10. Each of the generally triangular-shaped support portions 14*b* includes a slotted mounting portion 14*c* at an upper end thereof for mounting die forming shell 12 to support ribs 14, as discussed below. Support ribs 14 also include a base portion 14*e* and a generally vertical, central support leg 14*d* that extends upward from the base 14*e* and toward a lower portion of the generally U-shaped center portion 14*a*.

Metal forming system 10 may include endplates 43 (FIG. 6) located on opposite ends of base 25. Endplates 43 substantially enclose die components 12, 14 and cooperate with base 25 to provide a frame structure for secure fastening of the die components. The endplates may include slots 43*a* adapted to receive an air dam (discussed below) and a plurality of holes or apertures 43*b* for mounting the endplates to other structures, such as base 25. Base 25 may optionally include machined slots or other receiving/retaining means 29 for receiving support portions 14*b* to locate and secure the support portions along the base. Slots 29 may engage base portions 14*e* of the support ribs to lock the support ribs to the base, such as via corresponding dovetail structures or the like. Base 25 may also optionally include a key slot 25*a* or a plurality of apertures or the like to facilitate bolting or fastening the support ribs to the base 25, such as via one or more fasteners 27, for locating and/or securing the support ribs and shell to the base. In the illustrated embodiment, key slot 25*a* is also adapted to receive the head of one or more bolts 27, and/or may be configured to assist in securing and/or retaining the base to another structure or surface. The base 25 may further include a step or wider portion 25*b* (FIG. 7A) for securing the base to a surface, such as via clamps or bolts.

As shown in FIG. 5, die forming shell 12 (when portions 18, 20 are mated together) includes a gap or void 22 along each opposed edge or side of lower portion 18 and upper portion 20 and extending along the body of die forming shell 12 between lower portion 18 and upper portion 20. Void 22 substantially prevents or inhibits electrical current from flowing around die forming shell 12 when lower portion 18 and upper portion 20 are joined by functioning to open an otherwise closed electrical circuit around the perimeter or circumference of shell 12.

Similarly, support ribs 14 are electrically isolated and adapted to inhibit or substantially preclude electrical current from flowing therethrough and therearound. For example, a gap or space 24 is established between an upper end of the vertical leg portion 14*d* and the lower surface of the central, generally U-shaped portion 14*a*, thereby limiting or substantially preventing formation of a closed electrical circuit around the triangular-shaped support portion or rib 14*b*. Further, the opposed surfaces of the upper end of vertical leg portion 14*d* and the lower surface of U-shaped portion 14*a* may be coated or otherwise electrically insulated or isolated from one another. Voids or gaps 22 and 24 open what would otherwise be a closed circuit in die forming shell 12 and support ribs 14, respectively, by disrupting the conductive continuity of the shell and rib structures. Optionally, voids or gaps 22 and/or 24 may be filled with insulating elements that are substantially electrically non-conductive to further impede the current flow around and/or through die forming shell 12 and/or support 14. Such insulating elements may be disposed in voids 22 or gaps 24 to avoid any metal-to-metal contact between adjacent component surfaces, and may further be sufficiently rigid and strong to maintain the desired spacing or size of gap 24 and/or void 22.

Therefore, electrical current will be impeded or substantially precluded from flowing through die forming shell 12 and support ribs 14 because shell 12 and support ribs 14 do not provide a closed circuit for flow of electrical current therethrough and therearound. The components of the die are thus rendered substantially transparent to the current flow induced by inductive heating coils 16, thereby mitigating the heat buildup in such components that would normally result from such current flow (as discussed in detail below). Thus, the induction heating process that heats the tubular member T within die forming shell 12 will not substantially heat the components of the die, allowing such components to remain rigid and intact during the part forming process (described in detail below).

In the illustrated embodiment, die forming shell 12 is received into the U-shaped portion 14*a* and secured to the support ribs by a plurality of slotted tabs 32 (FIG. 1) that extend rigidly outwardly and generally horizontally from the die forming shell, while support ribs 14 include a slotted mounting portion 14*c* (FIGS. 7A-8A) for receiving tabs 32 therein. When tabs 32 of die forming shell 12 are inserted into slotted mounting portion 14*c* of support ribs 14, a retaining element or pin 34 (FIGS. 9-10) may be inserted through the slotted portions 14*c*, 32 to substantially retain die forming shell 12 relative to support ribs 14 and limit or substantially preclude relative movement between die forming shell 12 and support ribs 14 during the heating and inflating/forming processes. The surfaces of tabs 32 of the die forming shell and the inner surfaces of slotted portion 14*c* of the support ribs may be coated with a non-conductive coating, such as a ceramic coating or the like, so that die forming shell 12 is substantially electrically isolated or insulated from support ribs 14 when attached thereto. Optionally, retaining pin 34 may also be coated with an insulating layer or material and/or may comprise a non-conductive material, such as a ceramic material or silicon carbide material or the like, to further limit or inhibit the flow of electrical current therethrough. To further inhibit or impede the flow of electrical current through components of the die, the outer surface of the shell may be spaced from the support ribs so that contact between the shell and support ribs only occurs at the coated tabs and mounting portions. Optionally, the outer surface of the shell and/or the U-shaped portion of the support structure may be coated with an insulating layer or material to limit current flow through the components.

Figure 8A:
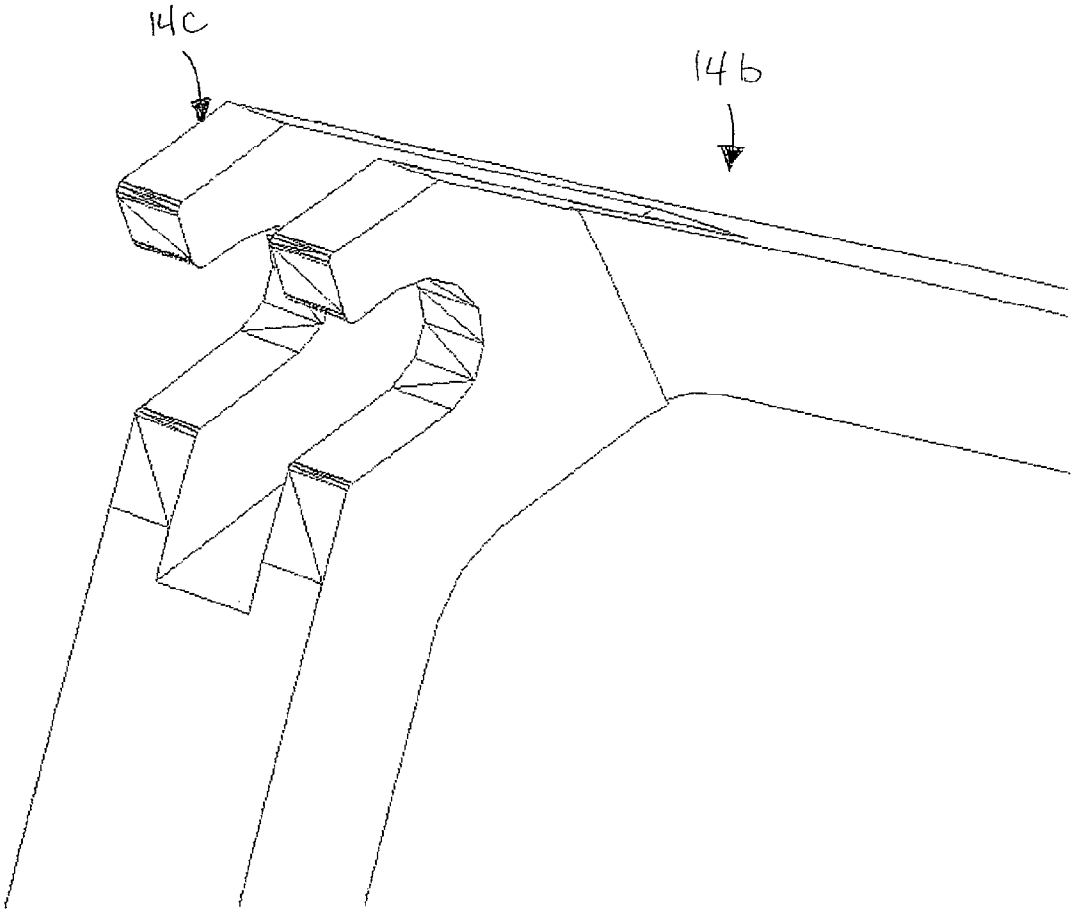
FIG. 8A is an enlarged perspective view of a mounting portion of a support rib of the present invention.
Figure 8B:
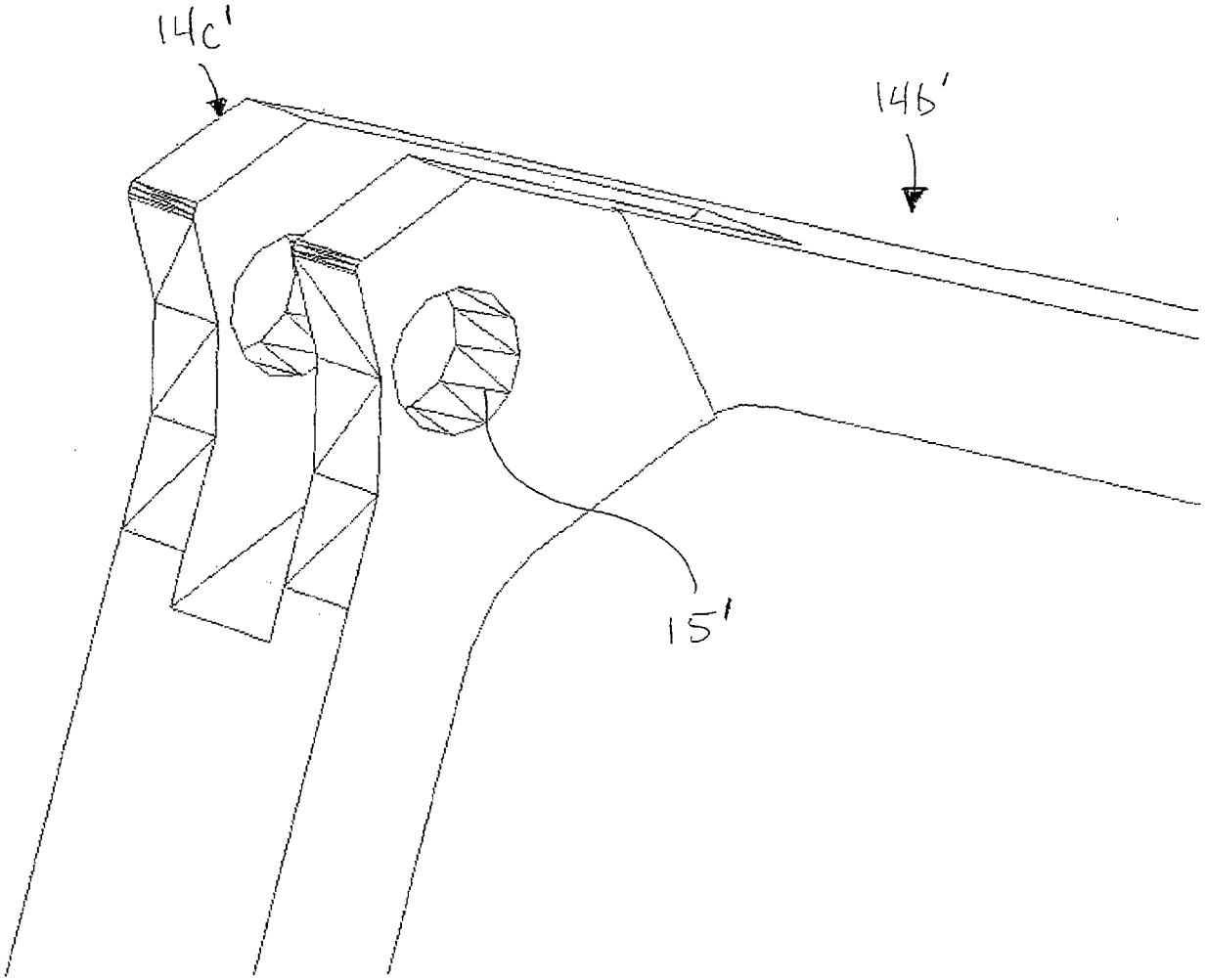
FIG. 8B is an enlarged perspective view of a mounting portion of another support rib of the present invention.
Figure 9:
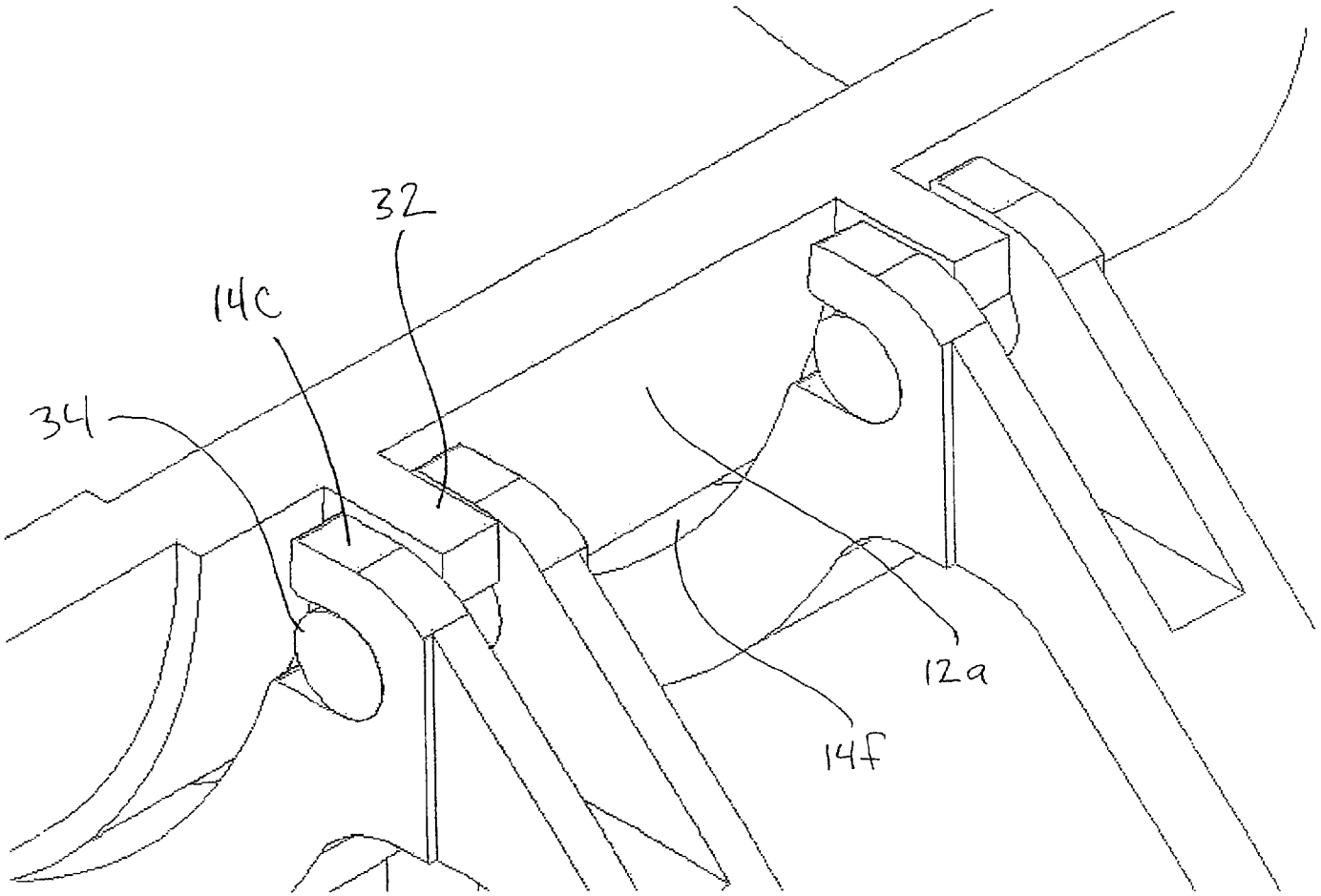
FIG. 9 is an enlarged perspective view of a pair of support ribs supporting the respective regions of the die forming shell, with a pin received through the support ribs and die forming shell to retain the die forming shell relative to the support ribs.

Optionally, and as shown in FIG. 8B, it is envisioned that the mounting portion 14*c*' of the support ribs 14*b*' (and optionally, the tabs of the die forming shell) may have apertures or bores 15' formed in a closed mounting portion 14*c*', for receiving retaining pin 34 therein. However, if aperture 15' is formed through the mounting portion, some heating may occur at the mounting portion during the induction heating process. For example, a current path may develop or may be induced around the opening or hole or aperture 15' and thus may generate heat at mounting portion 14*c*' of support ribs 14*b*'. In order to reduce this possibility, it is desirable that the mounting portion of the support ribs and the tabs of the die forming shell be formed with open ended slots (such as discussed above) to further limit or substantially preclude electrical flow in a circuit around the mounting portion, as may otherwise occur around a mounting portion with an aperture and without an open ended slot at the mounting portion. Optionally, the tabs of the die forming shell may also be slotted to limit or substantially preclude induction heating at the tabs during the heating process. Accordingly, the slotted mounting portion and tabs limit or substantially preclude the ability of the tabs and/or the support ribs to inductively heat at the tabs and/or mounting portion.

Optionally, and desirably, the outer surface 12*a* of die forming shell 12 (such as the lower surface of lower portion 18 of shell 12, shown in FIG. 10) may be spaced from the opposing surface 14*f* (FIG. 9) of the support structure or ribs 14, and may have a ceramic insert or other non-conductive or electrically insulating material disposed between outer surface 12*a* of die forming shell 12 and inner surface 14*f* of the support structure to electrically insulate die forming shell 12 from the support structure, including support ribs 14, at any opposing or engaging or contacting portions. Further, the parting line of die forming shell 12 (where the opposed portions or surfaces 18*a*, 20*a* of lower portion 18 and upper portion 20 may oppose one another and form void 22 or may mate together when the shell is assembled) may have a ceramic coating or other electrically insulating material disposed thereat to limit or substantially preclude electrical current flow around die forming shell 12 during the induction heating process.

During operation of the induction heating assembly 10, a component or workpiece, such as tubular member T or the like, may be positioned within lower portion 18 of die forming shell 12 that is supported by the support ribs 14, and an upper portion 20 of die forming shell 12 of similar construction may be positioned at or adjacent to lower portion 18 and secured relative thereto, thereby encasing tubular member T within die forming shell 12. The inductive heating coils 16 may then operate to generate an electrical current flow that induces current flow through tubular member T within die forming shell 12 to substantially heat tubular member T to a desired or appropriate temperature prior to a gas forming inflation of tubular member T. However, other induction heating processes may optionally be used to heat a tubular member or component, such as those found in U.S. Pat. Nos. 6,322,645; 6,613,164; 7,003,996; 7,024,897; and 7,269,986, which are hereby incorporated herein by reference in their entireties. Because the encasing of die forming shell 12 is electrically insulated between its opposed and/or mating surfaces 18*a*, 20*a* (as described above), inducement of electrical current around the die forming shell 12 is limited, so that the temperature of die forming shell 12 remains substantially lower than that of tubular member T during the induction heating process. Likewise, because of the electrical insulation of opposed portions 14*a*, 14*d* of support ribs 14, inducement of electrical current within the support ribs and, thus, induction heating of the support ribs, is also limited during the induction heating process. Likewise, because of the electrical insulation at the mounting portions and tabs of the assembly, inducement of electrical current at the mounting portion of the support ribs and the tabs of the shell and, thus, induction heating of the ribs and shell, is also limited during the induction heating process. Thus, the metal forming system of the present invention functions to substantially heat a tubular member within a die forming shell via induction heating induced by heating coils, without substantially heating the metallic die forming shell itself or the metallic support ribs that support the die forming shell.

Although the electrical insulation and open-circuit design of die forming shell 12 and support ribs 14 reduces the potential for inductive heating of die forming shell 12 and support ribs 14 (as described above), it is envisioned that some heating to these elements may occur during the heating process, such as via induction heating or via radiation heating or conduction heating from the heated tubular member T within die forming shell 12. Thus, it may be desirable to provide a cooling system or means for cooling the support ribs and/or the die forming shell during the heating process. In the illustrated embodiment, this is accomplished by circulating a cooling agent near or on or adjacent to the surfaces of the components that are to be cooled. Such a cooling agent may comprise a gas or a liquid or a gas combined with a liquid or the like circulated around the die components. For example, the cooling agent may comprise a gas, such as ambient air, that may be blown or otherwise circulated around the components.

Figure 12:
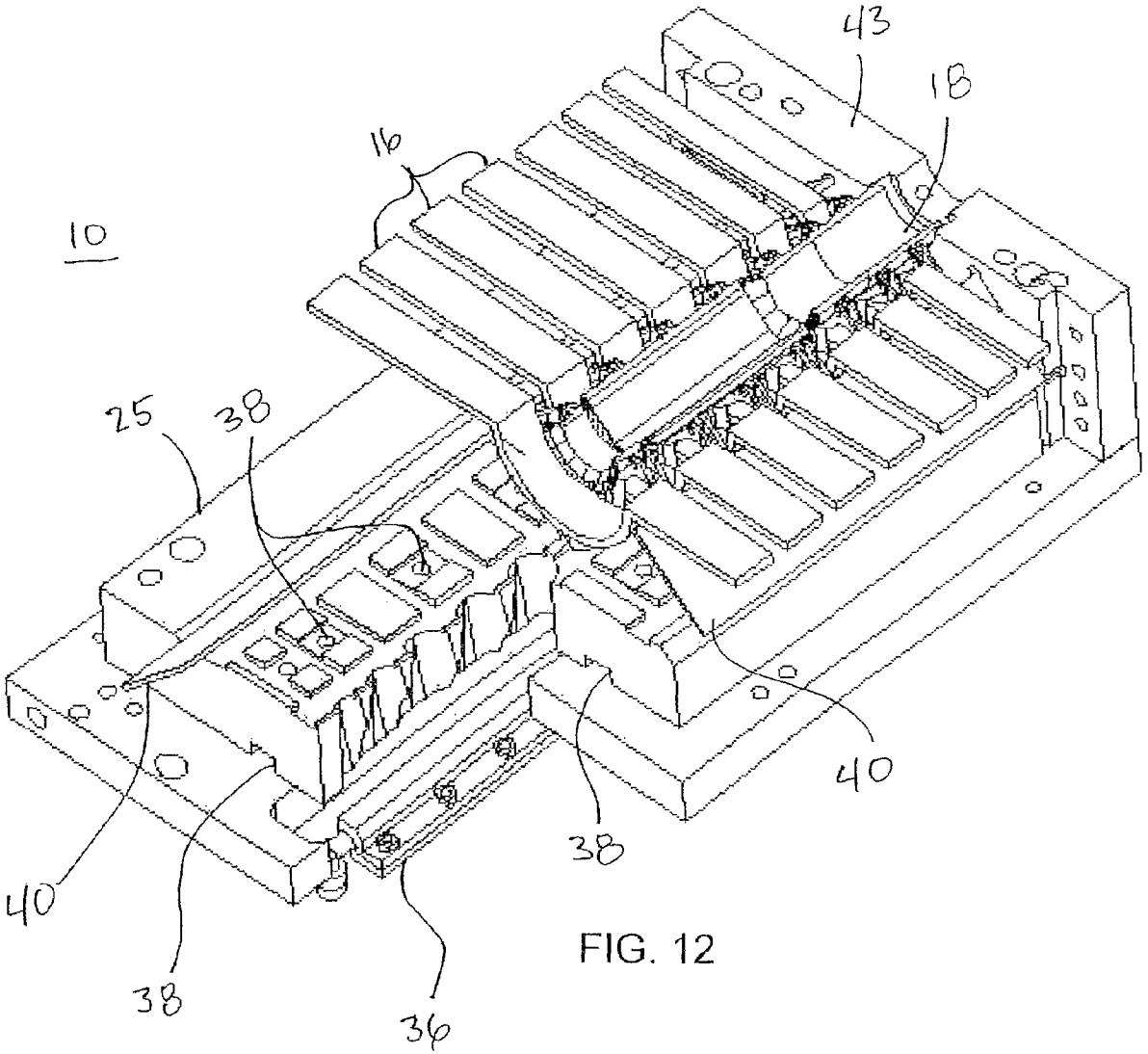
FIG. 12 is a perspective view of a portion of the die forming shell and support ribs and heating coils of the present invention, shown with a base and a cooling system.

For example, and with reference to FIG. 12, one or more air knives 36 may be provided to direct air or fluid under pressure into the die and at and along die forming shell 12 and/or support ribs 14, and/or a fluid under pressure may be directed on the die forming shell, such as directly onto the die forming shell, to cool the die forming shell and/or support ribs and draw heated air away from the die forming shell and/or support ribs. In addition, one or more air passageways 38 may be constructed in the die base 25 to enable a large amount of air or fluid under pressure to be passed into the die to cool the components thereof. Also, an air dam or deflector 40 may be constructed to channel the air or fluid under pressure to the components that need to be cooled. Thus, air knife or knives 36 may remove heat from die forming shell 12 or support ribs 14 that may be induced into the structures from the inductive heating process, or that may be conductively collected as a result of the formed part coming into contact with the heated or partially heated die forming shell 12, or that may be due to the radiant heat emanating from the formed part due to the induction heating of the formed part or tubular member T. The air cooling system or means may flow and circulate air at the support ribs and die forming shell, and may also include one or more air dams or deflectors 40 to direct forced air (as from air passageways 38) toward the desired or appropriate portions of die forming shell 12 and/or support ribs 14, thereby enhancing the cooling thereof by circulating air or other fluid at an ambient or cool temperature around the components of the die. The die forming shell may be cooled during the cooling process, whereby the cooled die forming shell may remove heat or draw heat away from the formed component. The temperature of the formed component may be regulated, such as by varying the flow rate and/or flow volume and/or flow pressure and/or temperature of the coolant fluid in or around the components of the die and/or by varying the amount of power applied to the inductive heating coils. Thus, the temperature of the die forming shell (and thus the temperature of the part formed therein) can be regulated to assist in the heating (such as via conductive heating of the part) and cooling of the part during the part forming process and the die forming shell and/or the part formed therein may be exposed to a temperature profile, such as by utilizing aspects of the forming systems described in U.S. patent application Ser. No. 12/124,354, filed May 21, 2008, for METHOD AND SYSTEM FOR TAILORING MATERIAL PROPERTIES OF A STRUCTURAL COMPONENT, now abandoned, and/or U.S. provisional applications Ser. No. 60/939,463, filed May 22, 2007; and/or Ser. No. 61/017,387, filed Dec. 28, 2007, which are hereby incorporated herein by reference in their entireties.

Optionally, a liquid may be used to cool the components or to remove the excess heat from the die. It is envisioned that such liquid may be pumped into the die through cooling channels or conduits. For example, and with reference to FIG. 13, the cooling system or means may comprise a liquid cooling means, such as a liquid cooling system, which may include a pipe or conduit 42 suitable for transporting liquid coolant fluid such as water. In the illustrated embodiment, pipe 42 is established within and adjacent to the side or support portions 14*b* of support ribs 14 to draw heat from support ribs 14 to the liquid coolant within conduit or pipe 42 to thus cool support ribs 14 during the induction heating process. Such water or coolant fluid may enter pipe 42 at a first entry or end 42*a*, flow through pipe 42 and collect heat from the adjacent material of support rib 14, and exit at a second exit or end 42*b* of pipe 42. In the illustrated embodiment, there is one coolant pipe 42 within each support portion 14*b* of supports 14, though more or fewer may be used. The end or ends of pipe 42 may have tubes connecting them to an external fluid source or the like, or may be connected to a manifold adapted to provide fluid to a plurality of pipes 42. Optionally, the fluid may be chilled or refrigerated for more effective cooling. However, it will be apparent to the skilled artisan that other cooling systems or means may be implemented to cool the die forming shell and/or the support ribs during the induction heating process, while remaining within the spirit and scope of the present invention.

Figure 14C:
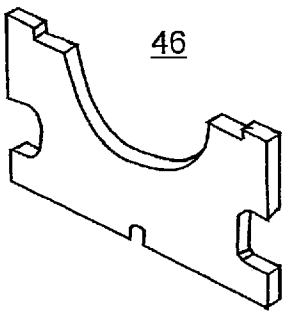
FIGS. 14A-14C are a perspective view and end views of a ceramic die forming shell support in accordance with the present invention.
Figure 14B:
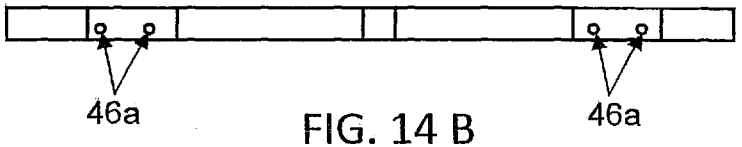
Figure 14A:
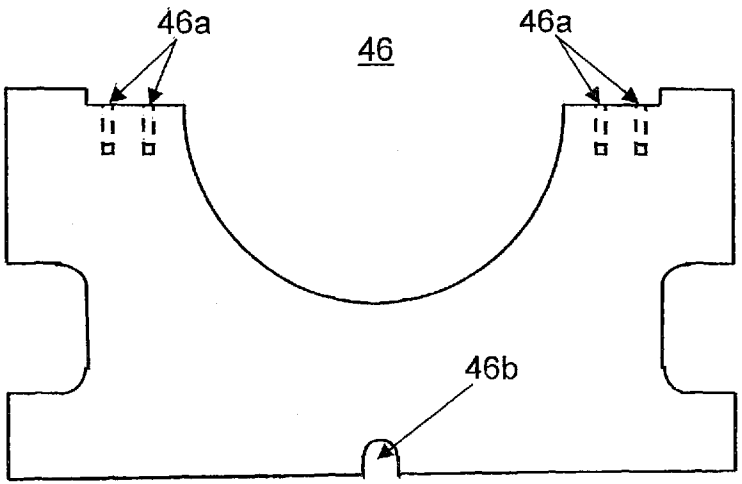

Optionally, and with reference to FIGS. 14A-14C, it is envisioned that the support ribs for supporting the die forming shell may comprise a ceramic material, in order to substantially reduce or limit or substantially preclude inductive heating of the ribs during the induction heating process. Thus, a plurality of ceramic plates or ribs 46 may be provided and formed for supporting the die forming shell in a similar manner as described above. A ceramic or other non-magnetic material may be used as spacers between the ceramic ribs 46, and/or a cooling means or systems may be provided to cool the ceramic ribs during the induction heating process that heats the tubular member within the die forming shell. A lower die portion with a plurality of ceramic plates and a die forming shell may be mated with an upper die portion having a similar plurality of ceramic plates and die forming shell (note that support ribs 14 and die forming shell 12, discussed above, may be mated and secured together in a similar manner).

The ceramic plates 46 are machined ceramic plates that can withstand high heat and are substantially "invisible" to the conductive heating coils, and are structurally robust. The plates are constructed from ceramic materials, such as machinable ceramic materials, such as macor or the like, or ceramic materials that are constructed in the machine to a final shape. The ceramic die forming shell support structure permits the easy assembly and disassembly of the die forming shell tooling for construction or repair, and permits design flexibility of the tool. For example, plates 46 may include one or more threaded bores 46*a*, such as for threadably attaching a die forming shell to the plates. The ceramic die forming shell support structure also permits the separation of parts of the die from other parts and allows for the thermal expansion of the die forming shell during the heating and forming process. The ceramic shell support structure also allows for thermal radiation and/or isolation of the die forming shell heat build up. The ceramic ribs or plates or shell support structures 46 function to support the die forming shell in position relative to the hot metal gas forming die during the forming process, and may include a key slot 46*b* adapted to engage a key or protrusion on a mounting surface (similar to the key slot discussed above). The ceramic plates enable effective manufacturing tooling and use of expendable replacement components, and may enable the manufacturer of the gas forming process tooling to have more efficient manufacturing/marketing of the process. The ceramic plates 46 may provide greater flexibility for design changes and efficient repair and may incorporate use of metal structures which are substantially transparent or non-susceptive to magnetic fields.

Figure 15:
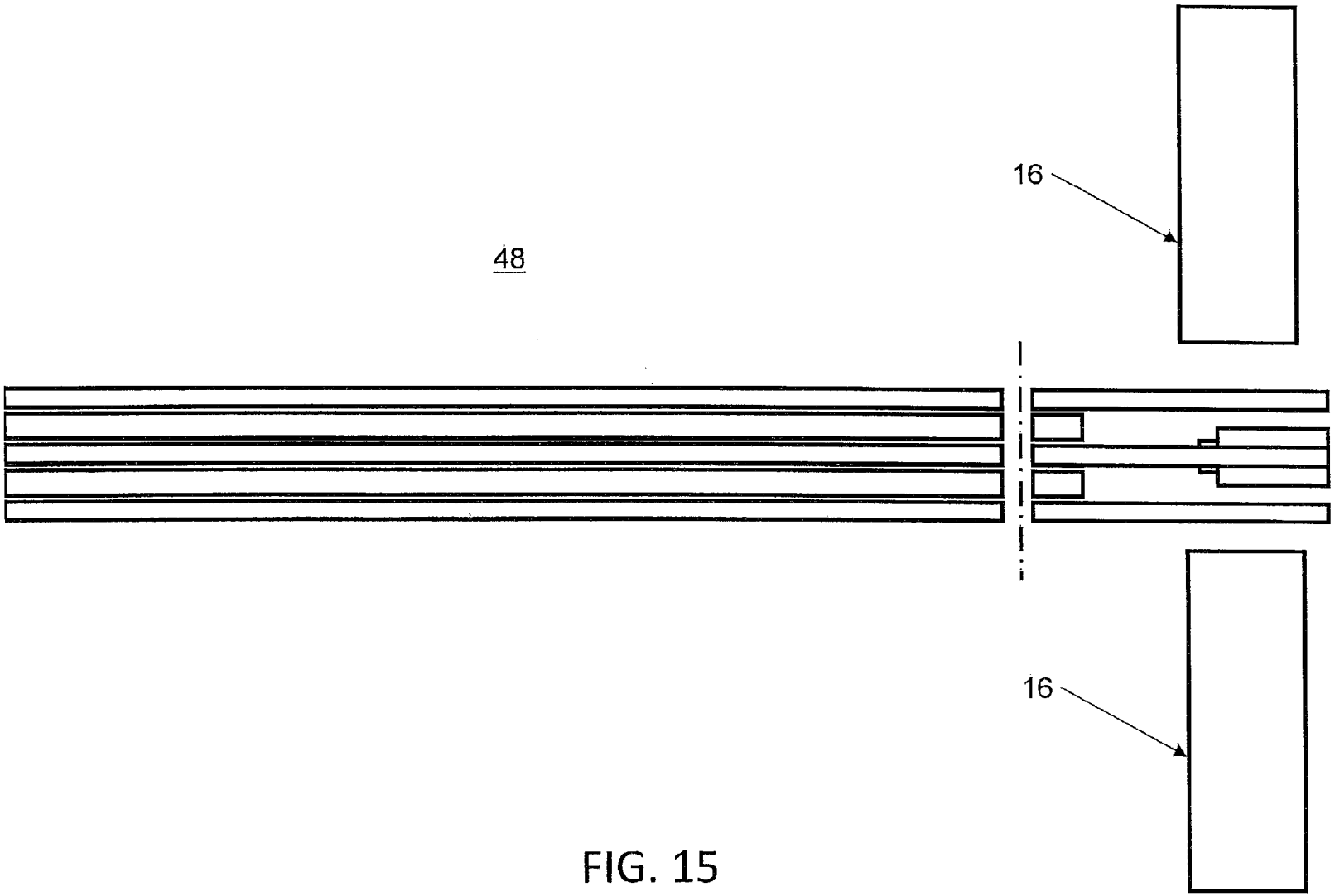
FIG. 15 is an end view of a laminated support plate, shown with induction heating coils.
Figure 16:
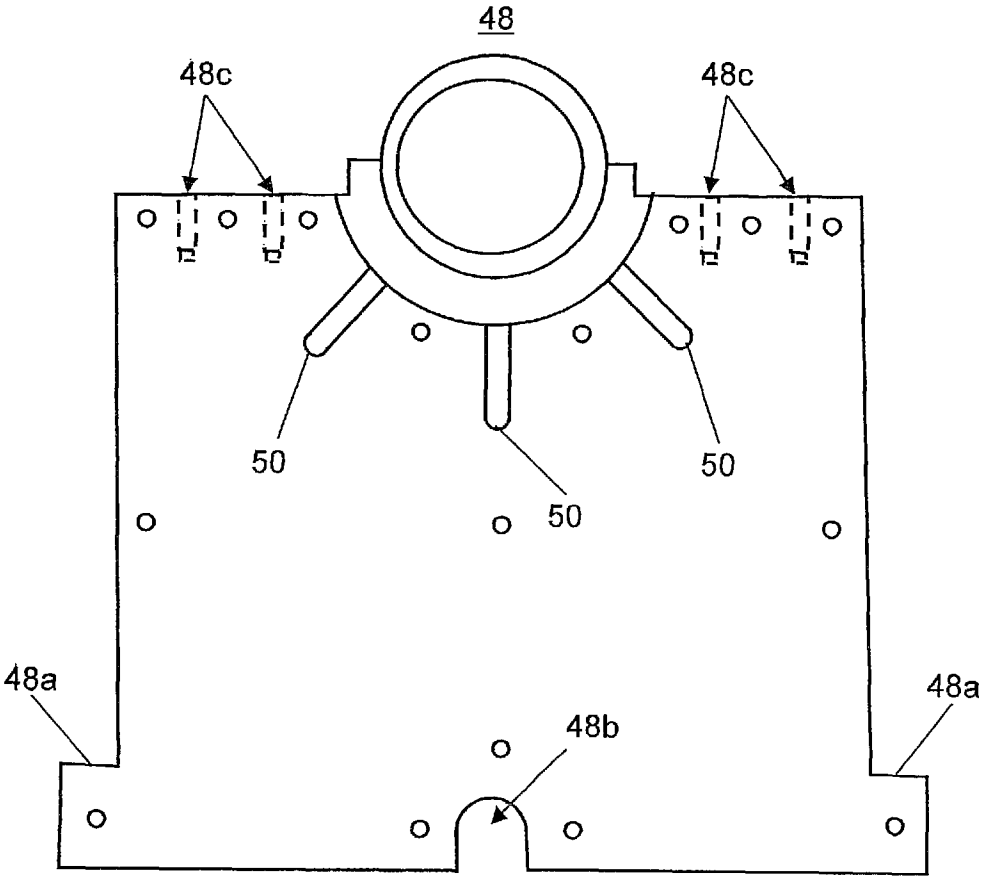
FIG. 16 is an end elevation of a laminated support plate or rib for supporting a die forming shell in accordance with the present invention.

Optionally, and with reference to FIGS. 15 and 16, a laminated plate or rib structure 48 may be implemented for the support plates that support a ceramic or non-ceramic die forming shell in a similar manner as described above. The plates may comprise stainless steel plates and/or inconel plates and a micarta or glass laminate or suitable ceramic material plates or other material that is not substantially electrically conductive, which are provided as an insulating material between the stainless steel plates, to form a laminated plate structure. As shown in FIG. 16, notches 50 may be provided in the plates and in the path of the induction heating coils 16 to further limit or reduce or hinder the formation of electrical eddy currents in the stainless steel plates during the induction heating process. Other gaps or insulating elements or the like may be provided along the plates and/or between the plates to further limit or hinder the inducement of such eddy currents in the plates during the induction heating process. The plate structure may also include a base portion 48*a* and/or a key slot 48*b* for securing the plate structure to a mounting surface, similar to such structures discussed above. The plate structure may also include one or more threaded bores 48*c*, such as for mounting a die forming shell to the plate structure.

The laminated rib structure 48 may utilize machined ceramic plates because such plates can withstand high heat and are substantially "invisible" to the inductive heating coils 16 and are structurally robust. The ceramic plates, such as ceramic material comprising macor or the like, are disposed between thin steel plates to form the laminated rib structure 48. Because of the thickness of the stainless steel plates, the thin steel plates will encounter very little inductive heating during the inductive heating process. Optionally, and because of the low permeability of the laminated support structure, the laminated support structure may be arranged generally perpendicular or generally parallel (or at other angles as may be desired) to the inductive heating coils and/or the current path.

During the induction heating and gas forming of a three-dimensional structural tubular member, the ends of the workpiece or tubular member T must be sealed or plugged, so that the gas may be provided within the tubular member at substantially high pressure to expand the tubular member to the shape defined by the inner surfaces of the die forming shell. Any suitable end sealing device may be utilized to seal the ends of the tubular member during such a process.

Accordingly, a three-dimensional formed product may be formed via the metal forming system of the present invention by providing an induction heating coil for induction heating of a tubular member, providing a die forming shell for supporting the tubular member and for defining the final shape of the formed product, and providing a metallic and/or ceramic support structure comprising one or more support ribs for supporting the die forming shell during the induction heating of the tubular member. The support structure includes insulating portions and/or open-circuit structures to limit or substantially preclude inducement of electrical current through the support structure during the induction heating process, as discussed in detail above. For example, two portions (such as a lower portion and an upper portion or the like) of the die forming shell may be substantially mated together so that the inner surfaces of the two portions cooperate to form the cavity that defines the shape of the formed product. An insulating material may be provided at one or more of the mating surfaces, such as in a void or gap at or between the die forming shell portions or halves or other portions to limit or substantially preclude inducement of electrical current around the die forming shell or from one portion of the die forming shell to the other portion of the die forming shell. An insulating element may also be provided between the die forming shell and the support structure or support ribs where the die forming shell is engaged with the support structure or support ribs, thereby limiting or substantially precluding inducement of the flow of electrical current from one of the die forming shell and the support structure to the other of the die forming shell and the support structure. The tubular member is substantially enclosed in the cavity of the die forming shell and inductively heated along its length, thereby increasing the malleability or ductility or workability of the tubular member while the die components remain cool enough to substantially retain their rigidity and strength. Such heating allows the tubular member to be formed into a formed product.

The method or process of forming a tubular member into a formed product comprises plugging or sealing the tubular member at one end and forcing gas or fluid at a high pressure into the plugged tubular member through another end until the tubular member conforms to at least a portion of the inner surfaces of the die forming shell, thereby altering the shape of the tubular member and forming the formed product. Such forming is accomplished by inductively heating axial portions of the tubular member by providing electrical power to heating coils located adjacent and along the die forming shell while or before the gas is forced into the plugged tubular member. The gas may comprise air, a mixture of air with at least part of the oxygen removed, a nitrogen gas at some purity level between 100 percent and the level normally found in air, or other suitable air/gas mixture (such as, for example, an argon gas mixture or other suitable composition), while remaining within the spirit and scope of the present invention. Note that the gas pressure may be between about 200 psi and about 5000 psi, and preferably between about 200 psi and about 2000 psi or thereabouts (or other pressure levels or ranges depending on the particular application).

Optionally, the support structures, which may include support ribs and/or ceramic plates and/or laminated rib structures (as discussed above), may be substantially parallel with the heating coils or current path (such as shown) or may be substantially perpendicular with the heating coils or current path or at other angles relative thereto. In applications where the support ribs may be arranged in a non parallel orientation with respect to the heating coil path, the support ribs may be formed and/or arranged so that the current flow depth through or along the structure is less than the reference depth of the material in the direction of the coil path, in order to limit or substantially preclude inductive heating of the support ribs or structure during the induction heating process.

Optionally, the gas may be heated prior to being forced into the plugged tubular member, thereby mitigating or reducing or substantially eliminating any cooling effect the gas may otherwise have on the tubular member and/or the upper or lower portions of the die forming shell. Alternatively, the gas may be heated to a temperature at or above the desired temperature of the tubular member, thereby allowing the gas to be used both for forming the tubular member (as described above) and/or for maintaining or increasing the temperature of the tubular member before and/or during forming.

Optionally, the formable blank or tubular member may be formed by applying mechanical stimulation to the tubular member during the forming of tubular member. The mechanical stimulation may include a vibratory actuator at least partially contacting the tubular member, a vibratory actuator at least partially contacting the first or lower die portion or half of the die forming shell, a vibratory actuator at least partially contacting the second or upper die portion or half of the die forming shell, a frequency pulsing of the tubular member, a pulsating of the fluid induced into the tubular member, and/or combinations thereof. Adding vibration in this manner may increase the formability of the tubular member.

Optionally, the induction heating may be varied along the length of the tubular member or blank, such as by utilizing aspects described in U.S. Pat. No. 6,322,645, which is hereby incorporated herein by reference in its entirety. For example, the induction heating may be generated by inductors spaced along the axial length of the tubular metal blank, and an alternating current may power such axially spaced inductors, whereby the heating variation may be achieved by varying the frequency of the alternating current. Note that varying the induction heating can be accomplished by various methods without departing from the spirit and scope of the present invention, such as by varying the frequency of the inductive heating field, by varying the spacing of the inductors or heating coils along the length of the tube, and/or by varying the distance between the inductors or heating coils and the tube to be heated, or a combination thereof and/or the like. Optionally, the induction heating coils may be contoured by utilizing more complex curves and surfaces to force inductive heating currents in complex three-dimensional components to achieve the desired temperature profiles.

Optionally, the heating and cooling system may include a heating element disposed within the die forming shell that is heatable during the induction heating of the component within the shell to assist in heating and forming the component to its final shape. For example, the inner surface of the shell may be coated with a heatable coating, such as a metallic coating or complex metallic structure that assists in heating the component. Such a coating or structure may be disposed at the inner surface of each portion of the die forming shell and the opposed edges of the coating or structure (along the parting lines of the shell) may contact one another (while the gap or void is established between the opposed edges of the shell itself) to allow for inductive heating of the inner coating or structure to assist in heating the part or component disposed therein. The inner coating or structure thus may be heated with the part and may assist in heating the part while also providing the form to which the part is to be shaped during the forming process. Optionally, the inner surface of the shell (or the outer or opposing surface or portion of the inner coating or structure) may be coated with or provided with a ceramic coating or non-conductive coating or layer or element or the like to limit or substantially preclude conductive heating of the shell during the component heating process.

After the induction heating and forming process is completed, the part may be cooled or quenched to the lower temperature. Optionally, the quenching of the heated part may cool the structural component to a given temperature above ambient for a predetermined period of time to provide arrested cooling of the formed component.

Accordingly, the present invention provides a die for heating and inflating and forming a tubular member via induction heating coils and gas or fluid inflation system. The present invention provides metallic or non-conductive die forming shells and support ribs, which are formed in a manner that limits or substantially precludes the inducement of eddy currents within the shell or ribs during the induction heating process, thereby resisting heating of the die forming shell and support ribs via induction heating. The die forming shell and support ribs preferably comprise a metallic material, which provides enhanced strength and durability to the system, while resisting heating of the die components during the heating and forming processes. The part forming system of the present invention thus provides an enhanced forming process over other known or proposed systems, since the metallic die forming shell and support ribs provide the desired and appropriate and sufficient strength of materials to withstand the pressures during the forming process, yet are configured or adapted to limit or substantially avoid the heating concerns previously encountered with such induction heating systems.

Changes and modifications to the specifically described embodiments may be carried out without departing from the principals of the present invention, which is intended to be limited only by the scope of the appended claims as interpreted according to the principles of patent law including the doctrine of equivalents.

The embodiments of the invention in which an exclusive property or privilege is claimed are defined as follows:

1. A method of forming a product via induction heating of a component and forming of the heated component, said method comprising:

providing an induction heating coil for induction heating of a component;

providing a die forming shell for supporting the component and for defining the final shape of a formed product formed from the component, said die forming shell comprising a metallic material;

providing a support structure for supporting said die forming shell during the induction heating of the component, said support structure comprising a metallic material, said support structure including insulating portions to limit or substantially preclude inducement of electrical current through said support structure during the induction heating process;

substantially joining two portions of said die forming shell together so that an inner surface of said two portions cooperate to form a cavity that defines the shape of the formed product;

inductively heating the component along its length while the component is in said cavity of said die forming shell; and forming the component into a formed product, whereby the component is at least one of (a) heated before the formed product is formed and (b) heated while the formed product is formed.

2. The method of claim 1, wherein said method comprises a method of gas forming a three-dimensional product via induction heating of the component and gas pressure inflation of the heated component to form the formed product.

3. The method of claim 2, wherein the component comprises a tubular member.

4. The method of claim 3, wherein forming the tubular member to the formed product comprises plugging the tubular member and forcing gas at a high pressure into the plugged tubular member until the tubular member conforms to at least a portion of the inner surfaces of said die forming shell to form the formed product.

5. The method of claim 1, wherein said support structure comprises a plurality of support ribs spaced apart along said die forming shell, each of said support ribs having at least one insulating portion to limit or substantially preclude inducement of electrical current through said support ribs during the induction heating process.

6. The method of claim 5, wherein said support ribs include a mounting portion for mounting a mounting tab of said die forming shell thereto, said mounting portion and said mounting tab being substantially electrically insulated relative to one another.

7. The method of claim 1, wherein at least one of said die forming shell and said support structure comprises at least one of inconel, stainless steel and cobalt.

8. The method of claim 1 further comprising controlling the temperature of the component by at least one of (a) providing a cooling fluid to the component and (b) controlling electrical power to said induction heating coil.

9. The method of claim 1, comprising providing an insulating material at at least one of the opposed surfaces of said die forming shell portions to limit or substantially preclude inducement of electrical current around said die forming shell or from one portion of said die forming shell to the other portion of said die forming shell.

10. The method of claim 1, comprising providing an insulating element between said die forming shell and said support structure where said die forming shell is engaged with said support structure to limit or substantially preclude inducement of electrical current from one of said die forming shell and said support structure to the other of said die forming shell and said support structure.

11. The method of claim 1, wherein the component comprises a blank that is heated and formed into the formed product.

12. The method of claim 11, comprising selectively heating and selectively cooling at least one portion of the blank to alter the material properties of the at least one portion of the blank while not substantially heating and cooling at least one other portion of the blank to achieve a targeted material composition of said at least one portion of the blank.

13. The method of claim 12, wherein the blank is selectively heated a plurality of times and selectively cooled a plurality of times to achieve the targeted material composition.

14. The method of claim 12, wherein selectively heating and selectively cooling at least one portion of the blank comprises selectively heating and selectively cooling a plurality of portions of the blank to alter the material properties of the portions of the blank, and wherein at least one of the portions of the blank has different material properties than at least one other of the portions of the blank.

* * * * *